US005671559A

United States Patent [19]

Ludaesher et al.

[11] Patent Number: 5,671,559

[45] Date of Patent: Sep. 30, 1997

[54] NON LETHAL FIREARM DEVICE

[76] Inventors: Edward C. Ludaesher, 1341 Gardenia St.; Joseph A. Kaniewski, 2301 Earhardt Ct., both of Oxnard, Calif. 93030

[21] Appl. No.: 488,593

[22] Filed: Jun. 8, 1995

[51] Int. Cl.[6] ..... F41C 9/00; A63H 3/18

[52] U.S. Cl. ..... 42/1.08; 222/79

[58] Field of Search ..... 42/1.08, 106; 222/3, 222/192, 79; 89/1.11

[56] References Cited

U.S. PATENT DOCUMENTS

| | | | |
|---|---|---|---|
| 1,269,922 | 6/1918 | Gadecki | 222/79 |
| 1,333,268 | 3/1920 | Masaites | 222/79 |
| 2,124,172 | 7/1938 | Wildes . | |
| 3,109,253 | 11/1963 | Eig | 42/1 |
| 3,298,125 | 1/1967 | Adrian | 42/1 |
| 3,374,708 | 3/1968 | Wall | 89/1.11 |
| 3,706,151 | 12/1972 | McNiell | 42/1 R |
| 3,707,793 | 1/1973 | Holtor | 42/1 G |
| 3,733,727 | 5/1973 | Jones | 42/1 R |
| 3,841,526 | 10/1974 | Haskins | 222/79 |
| 3,956,843 | 5/1976 | Litman | 42/1 F |
| 4,058,921 | 11/1977 | Mason | 42/1 G |
| 4,316,338 | 2/1982 | Mason et al. | 42/1.08 |
| 4,777,754 | 10/1988 | Reynolds, Jr. | 42/103 |
| 5,225,623 | 7/1993 | Krasnow | 89/1.11 |
| 5,397,029 | 3/1995 | West | 222/79 |
| 5,473,501 | 12/1995 | Claypool | 42/1.08 |
| 5,485,695 | 1/1996 | Glock | 42/103 |
| 5,581,898 | 12/1996 | Thummel | 42/103 |

FOREIGN PATENT DOCUMENTS

| | | | |
|---|---|---|---|
| 118813 | 9/1918 | United Kingdom | 42/1.08 |

*Primary Examiner*—Michael J. Carone
*Assistant Examiner*—Theresa M. Wesson
*Attorney, Agent, or Firm*—W. D. English

[57] ABSTRACT

A combination lethal/nonlethal firearm device is disclosed wherein a lethal gun, pistol or rifle that conventionally fires solid projectiles in the form of bullets, is conveniently converted to a non lethal defensive weapon by means of a novel attachment of a non lethal canister of dibilating chemical fluid such as tear gas or pepper gas to the barrel of the firearm. The canister is removably attached to the barrel by means of a saddle bracket attached to a trigger guard mounnting clamp, and where the direction of fire of the fluid propellant therein is along the firearm barrel and in the same line of fire as the trajectory of a solid projectile bullet of the firearm. Activation of the chemical dispenser is achieved by means of an activation plunger button adjacent the trigger guard in such manner that a peace officer may choose the better of lethal or non lethal defensive procedures.

14 Claims, 3 Drawing Sheets

NON LETHAL FIREARM DEVICE

BACKGROUND

1. Field of Invention

The invention disclosed herein relates to aggressive and self-defensive firearm devices. More specifically, the invention relates to combination pistol and handgun devices that can deliver a variety of non lethal debilitating fluid (liquid or gas) propellants and chemical agents as well as, and as an immediate alternative to use of conventional lethal firearm ammunition and solid propellants.

2. Description of the Prior Art

Due to the actual or perceived threat of violence in today's society, firearms are more likely to be the weapon of choice for both law enforcement personnel and also the public in general in situations where peace officers and potential victims must arm themselves in a defensive manner to be able to immediately meet or exceed a threat of unknown force.

Today's law enforcement personnel, peace officers, police officers, patrol officers, detectives, narcotics agents, special weapons and tactics squads (SWAT), drug enforcement agency (DEA), alcohol-tobacco-firearm agents (ATF), federal bureau of investigation agents (FBI) and other units are often poorly equipped to meet a threat of increasing violence and crime necessitating a variety of offensive and defensive maneuvers and weapons that can quickly change from a non threatening, non lethal environment to an immediate threat of serious bodily harm or death to an officer, victim or innocent bystander.

A patrol officer's mobile arsenal normally includes, among other elements a two way radio and belt loaded with a club, hand cuffs, ammunition, flash light, chemical dispensers, and a revolver or semi-automatic pistol. The more highly trained SWAT team more often rely on protective vests, camouflaged clothing and fully-automatic pistols such as an Uzi or (automatic pistol) MP-5 multiple firing type hand gun. However, in an effort to limit unnecessary harm to victims, innocent bystanders, as well as suspects and perpetrators of crimes, and in consideration of the consequent potential liabilities there involved, severe restrictions are placed on use of lethal weapons which may unfortunately put an officer in harm's way and subject our peace officer forces to undesirable and unnecessary risk of harm. Officers entering hostile situations are rarely informed as to the extent of violence to be encountered until faced with it. It is unreasonable to expect a peace officer to be fully equipped to handle each situation beforehand without complete and accurate information as to the circumstances.

Consequently, law enforcement and the public confront many situations with a firearm drawn for immediate use. Only then do they realize that deadly force is not justified but non-lethal action must be taken to prevent injury, escape or destruction of evidence.

When encountering these situations, peace officers may need only resort to a chemical debilitating agent, normally strapped to their belt. However, if their hands are occupied with a firearm pointed in the direction, the officer is unable to transition safely to another tool at his disposal latched in his bell. This results in the taking of unnecessary risks such as physical engagement of the individual while the officer has his firearm in his dominant hand. Other risks may include prematurely reholstering the weapon or use of the weapon with deadly force. With the advent and acceptance of two-handed grips, law enforcement officers are reluctant to remove one hand from the firearm to search for the chemical spray resident in his belt. Chemical sprays are normally located somewhere on the officer's utility belt or his entry vest. The officer is trained to continuously maintain a sight picture of the target in order to react immediately should the threat escalate. Additionally, an officer's other hand may be necessarily occupied manipulating doors or moving articles during searches.

The invention is a device which will eliminate the need for an officer to remove one hand from his weapon to reach for a chemical debilitating agent. The invention is a device which is conceived to be utilized in conjunction with a firearm. The invention creates a long needed method for delivering a chemical debilitating agent spray in the direction of the barrel of the fire arm while maintaining both hands on the firearm, pointed in the direction of the suspect.

This combination of chemical spray and firearm satisfies a desperate and long felt need of law enforcement and the public. The invention provides an option which when utilized can de-escalate certain situations. A primary example of one of these situations is one in which the user has a firearm drawn, physical engagement is to be avoided and deadly force is not yet justified. However, the situation is such that less than lethal force must be taken while the option of deadly force is maintained.

In order to competently handle such a situation, the invention is designed to be a device that can be a removable attachment to or an integral part of a firearm, such as a standard revolver, semi-automatic handgun, fully automatic pistol, or shotgun. The invention enables a person to dispense a debilitating chemical agent in a direction parallel to the barrel of the firearm with little or no modification to the firearm. The invention attachment has little or no effect on the function or operation of the firearm.

The invention allows the user to take less than lethal action with a drawn firearm while still evaluating the situation. When the user is confronted with a person the user believes is armed or one who is armed with a weapon other than a firearm, the user can immediately and effectively disable the threat. The user does this by utilizing less than lethal force function of the invention attachment while never relinquishing the ability to use lethal force of the firearm itself if necessary. In today's civil rights climate, the use of deadly force is not encouraged and is greatly scrutinized even when obviously necessary under the circumstances. Effective use of the invention can reduce the liability exposure of both the public and law enforcement agencies equipped with it.

Prior to 1977, tear gas and other chemical debilitating agent dispensers were developed and well utilized. Even combination devices have been invented. For example, in U.S. Pat. No. 2,127,172 of Wildes, a tear gas dispenser in combination with a peace officer's billyclub is disclosed. The billy club extended the peace officer's area of intervention beyond the reach of the user; however, the tear gas device being in combination with a billyclub restricted the user to only non-lethal options.

Tear gas dispensing devices have been described in many different applications such as U.S. Pat. No. 3,109,253 of Eig, where a gas dispensing cartridge is hidden in a cigarette lighter adaptation, and in U.S. Pat. No. 3,208,125 of Adrian where an explosive gas dispensing cartridge is disposed in a pocket pen type device having a novel trigger release mechanism. Larger gun or rifle type fluid (gas and liquid) dispensing weapons have been described in U.S. Pat. No. 3,706,151 of McNiell where a shoulder mounted type rifle or gun is designed to deliver a volume of liquid or gas in a sabot, and hand or palm shaped gas dispensing devices or guns have been conceived to be covertly pocketed and hidden until needed as disclosed in U.S. Pat. No. 3,707,793 of Holtor. A non lethal, soft pliant latex projectile firing device in the form of a rifle is disclosed in U.S. Pat. No. 3,733,727 of Jones.

U.S. Pat. No. 3,841,526 of Haskins describes a device which discharges a debilitating fluid indirectly from a pistol or hand gun shaped device. This invention, however, could be dangerous as the invention would appear to be a lethal weapon to a suspect, but in fact is not a lethal weapon. Such a non-lethal weapon could actually exacerbate or escalate a situation in which lethal force was not necessary. Wielding what appeared to be a firearm could provoke a lethal response from an assistant who feared the lethal looking weapons. U.S. Pat. No. 3,956,843 of Litman discloses a launch tube tear gas firing device for covering a greater distance than normally attainable.

Ultimately, in 1977, a pistol was modified to allow the user to dispense a chemical agent from the butt end of a conventional firearm in U.S. Pat. No. 4,058,921 of Mason. "Firing" the chemical spray instead of firing bullet was accomplished while holding the pistol in a "safe" position with the barrel of the firearm pointed up. Law enforcement teachings of that era considered the barrel-up position a "safe" position. Today, however, law enforcement practices teach that to be in a "safe" position, the barrel of a firearm must be pointed where the holder is looking an in particular in the direction of a potentially armed suspect. A firearm pointed at the ceiling is no longer considered a "safe" position.

Much research and review of both critical incidents and officer involved shootings has been conducted over the last decade. Modern law enforcement teachings now dictate that peace officers, involved in high risk entries or other situations involving drawn firearms, should continuously aim their weapon at the target. Aiming one's weapon at a target is accomplished while looking over the barrel to maintain a "sight picture" of the subject and surroundings. In addition, while the firearm is continuously pointed at the target, the peace officer is instructed to hold the firearm in a manner such that the trigger finger remains outside of the trigger guard. By so holding the weapon, the possibility of accidental discharge of the firearm due to human involuntary reactions is substantially reduced. A trigger finger on the trigger guard and immediately adjacent to the trigger still allows the holder immediate reaction to an increased threat, should such a threat appear.

The trigger finger positioned outside of the trigger guard is the key to this invention. If the target subject does not escalate the threat with a firearm of his own, the peace officer can take immediate non-lethal action. The officer can take nonlethal actions if the suspect or target still refuses to submit to the officer's directions. The officer can readily dispense the chemical debilitating agent from his hand piece without relinquishing a two-handed grip thereon, and without spending valuable time and misdirecting his attention from the suspect to search for a less than lethal weapon. Non-lethal weapons available to peace officers are normally mounted on the officer's utility belt, but dictate some delay in their utilization due to the fact they are usually not already in hand.

What is needed, therefore, and supplied by this invention, is a suitable means of deescalating tactical situations not warranting lethal force. The user can instead resort to dispensing a chemical agent in those non lethal , non threatening situations while maintaining the preferred two-handed pistol grip and a sight picture of the target.

OBJECT OF THE INVENTION

A primary object of the invention is to provide for one who addresses a situation with a drawn firearm a safe method to quickly disable a threatening subject by lethal and/or non lethal means. Disabling a subject in such situations is accomplished by utilizing the invention in combination with a firearm to dispense a chemical agent such as tear gas, (Mace chemical agent, or pepper spray, all the while maintaining the ability to react immediately should the subject escalate the threat requiring the immediate necessity for lethal means. A general objective of the invention is to provide a dual-purpose weapon which can be deployed to quickly discharge its propellent, whether it be solid, liquid or gas, in a lethal or non-lethal manner.

A particular object of the invention is to provide an attachment to, or an adaptation for, an existing firearm to provide a lethal/nonlethal, dual-purpose weapon suitable for a variety of tactical situations which may warrant a drawn firearm.

An additional object of the invention is to provide a device and method for a peace officer to disable a threatening subject through use of a chemical agent such as chemical Mace, tear gas or pepper spray while continuously maintaining a sight picture of the target subject along the direction of the officer's firearm in order to be able to react immediately to the eventuality of an escalated threat.

A primary object and advantage of the invention is that a law enforcement officer so equipped, when displaying a firearm in conformance with an agency's policies and procedures, will have at his immediate disposal the ability to utilize either lethal or non-lethal force to contain a potential threat.

Yet another object and advantage of the preferred embodiment disclosed herein is its ready adaptability to retrofit existing firearms in use today with little or no modification to the weapon itself.

These and other less obvious objects and more advantageous features of the invention will become more readily apparent in view of the attached drawing as described by the following description specification and in light of the appended claims.

DETAILED DESCRIPTION OF A PREFERRED EMBODIMENT

Figures 1, 1A, 1B, 1C, 1D:
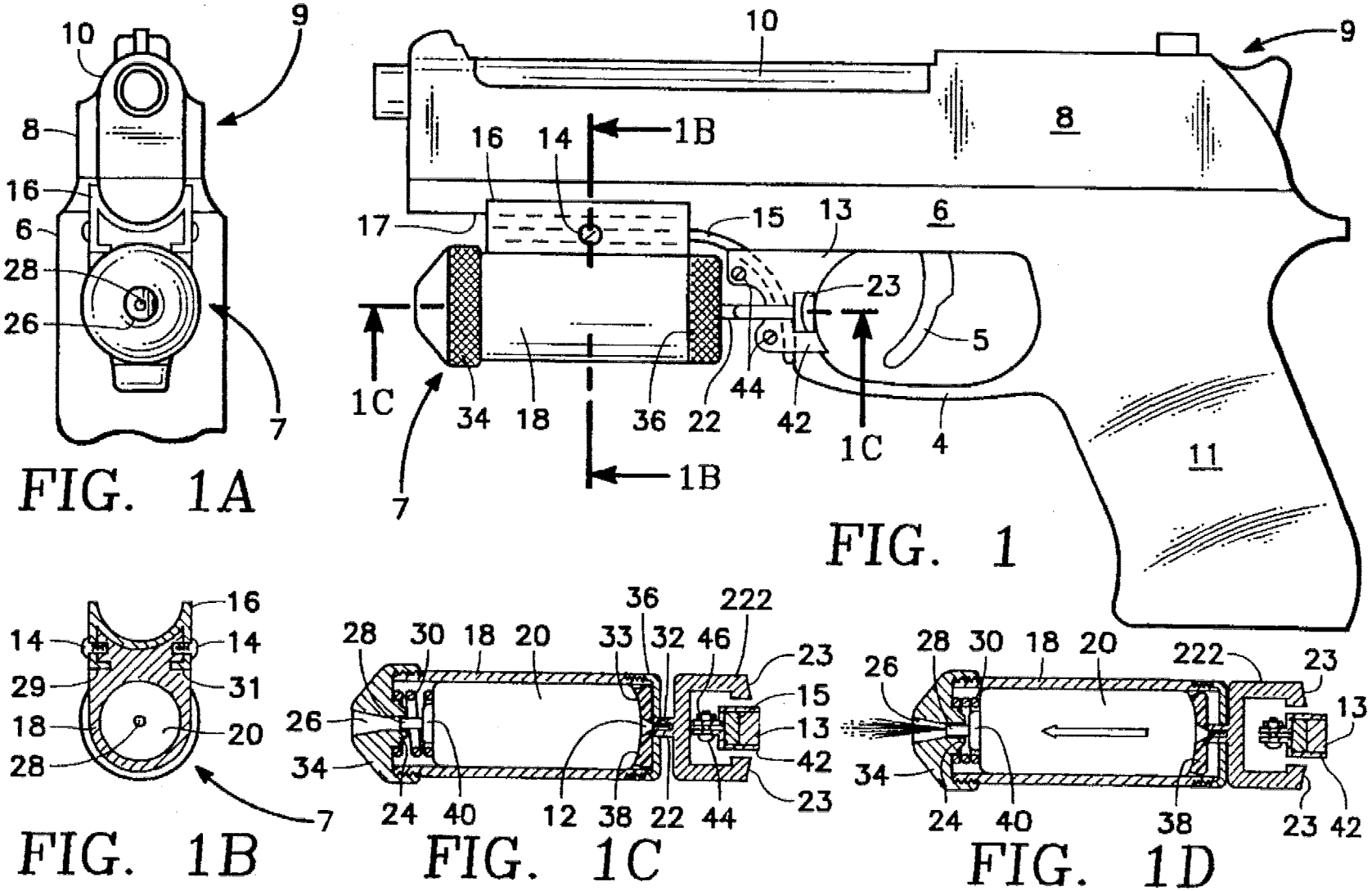
FIG. 1 is a side, elevational view of the invention concept illustrating a standard semi automatic pistol with the debilitating chemical dispensing device invention configured therewith.
FIG. 1*a* is a frontal, rational view of the invention concept depicted in FIG. 1 with the chemical dispensing device invention disposed below the pistol barrel.
FIG. 1*b* is a frontal, cross section view of the debilitating chemical dispensing device of FIG. 1.
FIG. 1*c* is a top, longitudinal cross section view of the debilitating chemical device of FIG. 1.
FIG. 1*d* is a repeated view of FIG. 1*c* with the release button pushed in the impelled forward actuated position.
Figure 3:
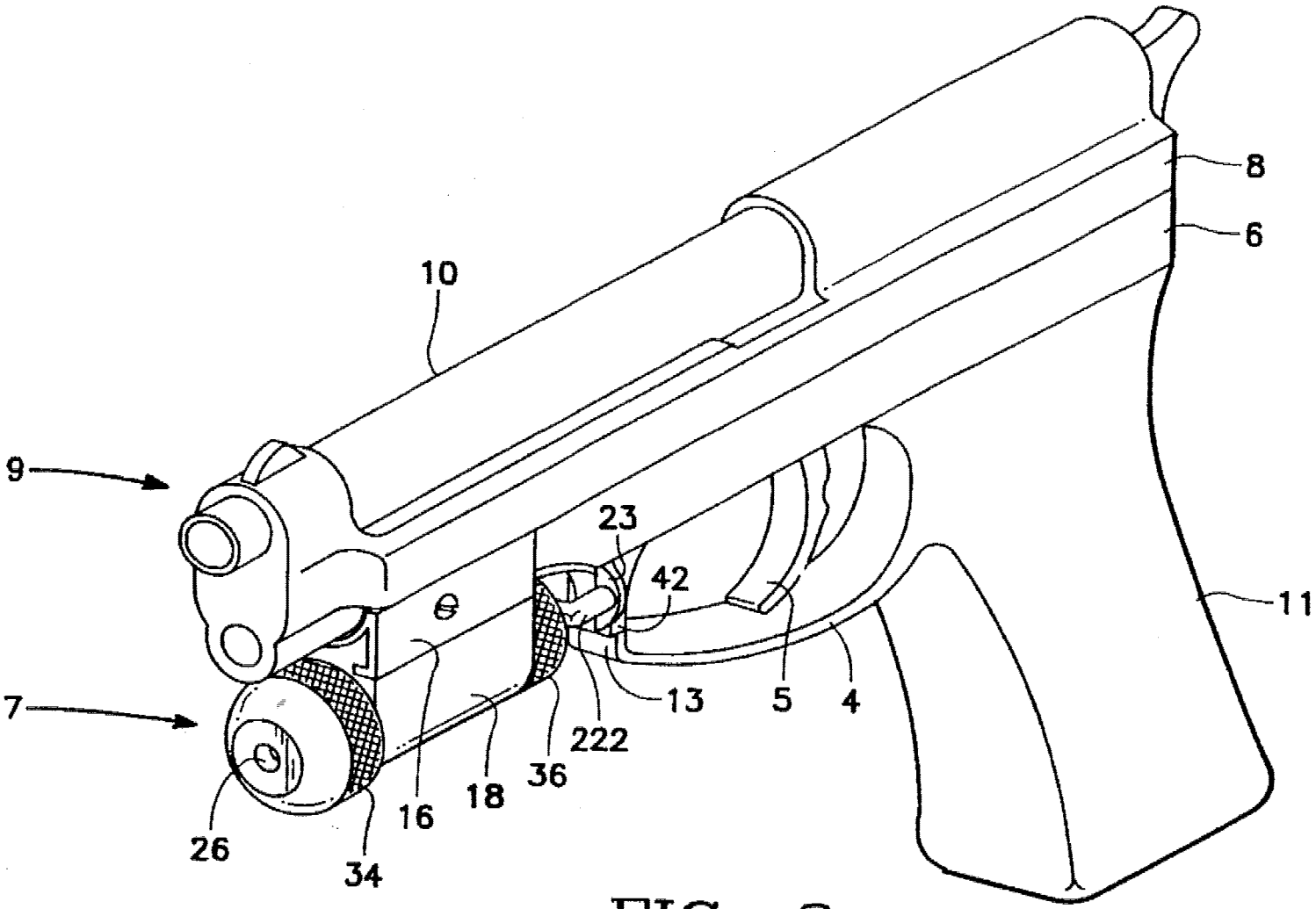
FIG. 3 is a perspective view of the invention chemical dispensing device as used in concert with a typical firearm.

Referring first to FIGS. 1 and 3, a lethal semi-automatic pistol 9, is illustrated with the attached non lethal invention, chemical dispensing device and assembly 7. Semi-automatic pistol 9 generally includes a movable slide 8, gun barrel 10, and nonmovable frame 6, which may have, among other elements, a trigger 5, a trigger guard 4, and a handle grip 11. The front element 13 of trigger guard 4 serves as a rear mount releasable attachment point, and the curved bottom 17 of non movable frame 6 serves as a top mount positioning seat for invention assembly 7.

It will be appreciated that a chemical dispensing canister housing unit 18 of the invention is generally oriented in parallel alignment with gun barrel 10. Housing unit 18 removably holds a cylindrically shaped chemical dispensing canister 20 of debilitating chemical substance under pressure. The substance in canister 20, such as (Mace chemical agent, is mounted within the housing unit 18, which permits discharge of the debilitating substance parallel to the barrel 10.

Figures 2, 2A:
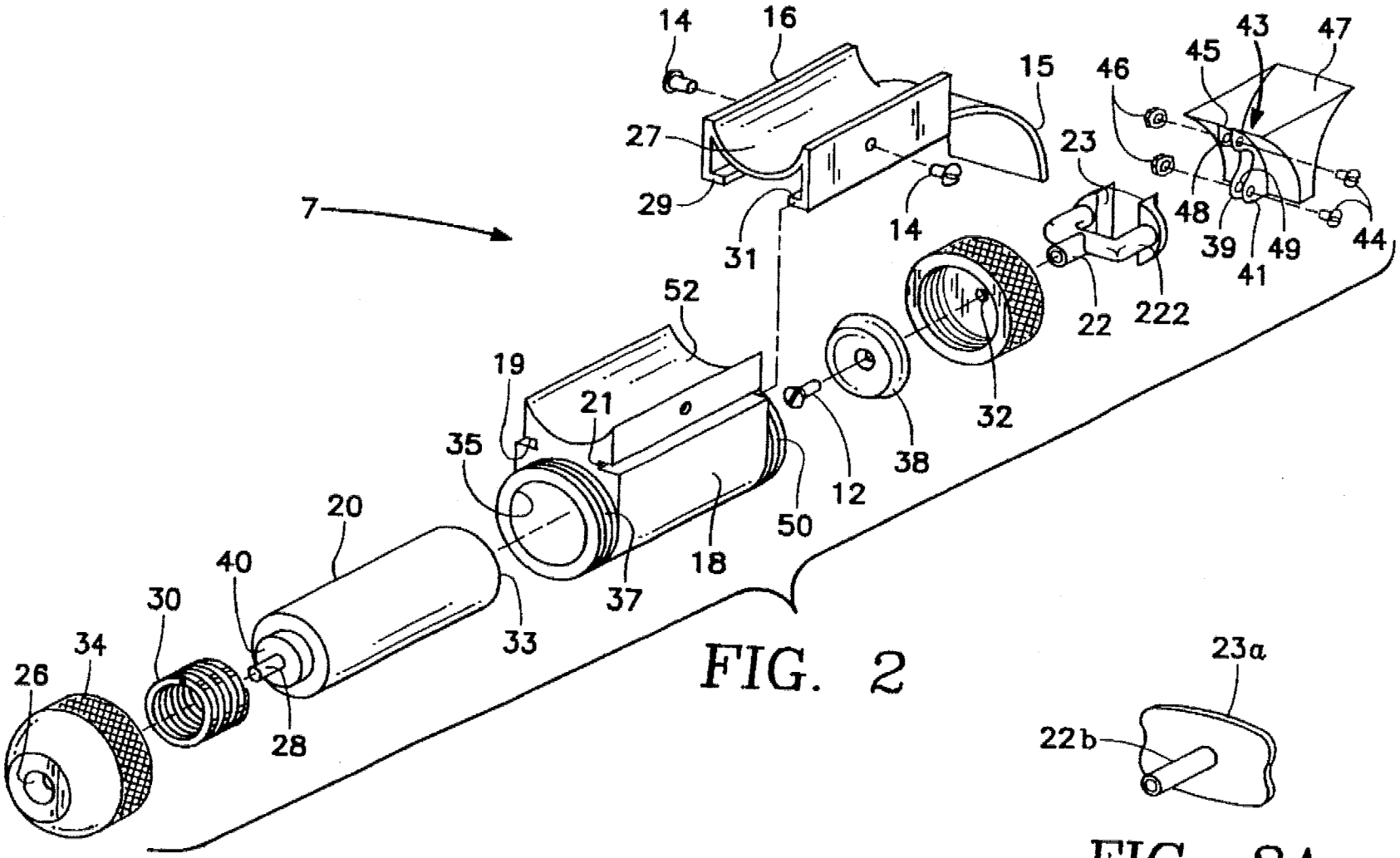
FIG. 2 is an exploded, perspective view of the gun mounted chemical dispensing device.
FIG. 2*a* is a perspective view of an alternate release button that may be more adaptable to other firearms with different trigger guard mechanisms.

Referring now to FIG. 2, a more detailed description of the invention is provided in an exploded, perspective view thereof. In the perspective view of FIG. 2, a trigger guard mounting clamp 42 can be observed to be in the general shape of a hollow cube with tapered forward 45 and tapered rear 47 sides thereof. Tapered forward side 45 is provided with a slitted opening 43 to enable one to open mounting clamp 42 to slip it around front clement 13 of trigger guard 4. A pair of parallel left 39 and right 41 lip extensions with upper 48 and lower 49 opposing paired holes enable one to secure a pair of set screws 44 through paired holes 48 and paired holes 49 with a pair of lock nuts 46 to tighten down mounting clamp 42 on trigger guard front element 13. A flexible mounting arm 15 extension of a housing mounting bracket 16 is curved in a manner similar to the curve of tapered front side 45, and as illustrated in FIG. 2, is designed to fit snugly inside mounting clamp 42. Mounting bracket 16 is provided with a curved trough 27, the curve of which is designed to match and somewhat ride as a saddle on the similarly curved bottom 17 of non movable frame 6. It will be readily apparent that as mounting bracket 42 is tightened down by adjustment of set screws and lock nuts 44 and 46, tension will be applied to flexible mounting arm 15 which in turn forces mounting bracket 16 to fit snugly up against non movable frame 6.

Mounting bracket 16 is further provided with downward extending vertical left and right mounting rails 29 and 31 for slidable receipt therein of left and right slots 19 and 21 of a canister housing unit 18. Housing unit 18 consists of a hollow cylinder 35 with front and rear threaded extensions 37 and 50 and having an upper surface 52 curved in the manner of mounting bracket 16 trough 27. It will be observed from the drawing that housing unit 18 is configured to slide into mounting bracket 16 by way of rails 29 and 31 slidably positioned in housing slots 19 and 21. Once in position a pair of set screws 14 are configured to hold housing 18 firmly in place in bracket 16.

A chemical dispensing canister 20 is configured to be removably disposed in housing 18, and is provided with a nozzle tube 28 conventionally coupled to an actuator button 40. When button 40 is depressed, a powerful stream of fluid is allowed to be expelled through nozzle 28. Once canister 20 has been inserted into housing unit 18, a housing unit front cap 34 is screwed down on threads 37 enclosing a first coil spring 30 which forces canister 20 away from cover 34. Referring to FIGS. 2 and 1*c*, it can be seen that nozzle 28 will impel a fluid through a cover aperture 26 when cover internal actuator ridge 24, by compression of coil 30, is allowed to contact actuator button 40 as illustrated in FIG. 1*d*.

Referring again to FIGS. 2 and 1*c*, a plunger shaft 22, supporting a forked end 222 of a pair of actuator buttons 23 disposed on either side of trigger guard frontal element 13, is designed to be allowed to pass freely through a plunger aperture 32 centrally disposed in a rear cap 36 of housing unit 18. Rear cap 36 is configured to screw onto rear threads 39 of housing unit 18. Plunger shaft 22 is caused to be impressed on a concave actuator plate 38 which is held fast to plunger shaft 22 by a set screw 12. Plate 38 in turn is caused to impress its concave curved surface against a similar convex curved surface 33 of the distal end of canister 20, thereby causing canister 20 to compress coil spring 30, enabling actuator ridge 24 to press upon actuator button 40 to expel the canister contents through nozzle tube 28. FIG. 2*a* illustrates yet another actuator button with similar plunger shaft 22*a* and a single but broad actuator button 23*a*. The actuator button 23*a* of FIG. 2*a* may, for example, work more appropriately on a shot gun, whereas the actuator button 23 of FIG. 2 works effectively on a hand gun/pistol.

Briefly, the illustrated and herein described invention 7 is mounted to trigger guard 4, by way of flexible mounting clamp 42. Mounting clamp 42 compresses mounting bracket 16, against the trigger guard 4. Clamp 42, is held in place through the use of one or more mounting set screws 44, with locknuts 46. Clamp 42, screws 44 and lock nuts 46, therefore, comprise a bracket mounting system.

Other methods which are available to attach mounting bracket 16, to frame 6 include, but are not limited to, counter sinking one or more set screws 14 through firearm frame 6, and/or through trigger guard 4. These screws would then be driven into corresponding threaded holes in mounting bracket 16. Mounting bracket 16, may also be affixed to the firearm 9 utilizing attachment means such as solder, weld and any number of adhesive materials. The firearm frame and mounting can also be redesigned to incorporate mounting bracket 16, and housing unit 18, into the structure of the weapon as manufactured.

Again, in short summary, the illustrated diagram of FIGS. 1 and 3 utilize trigger guard 4, bracket mounting system 42, 44 and 46. In said illustrated diagrams, housing unit 18, slides onto mounting bracket 16, and is held in place with two set screws 14. Reservoir canister 20, is seen to be mounted within housing unit 18. Housing unit 18, is contained by a front cap 34, and a rear cap 36. Front cap 34, has a actuator ridge 24, built into it. Front cap 34, has an aperture 26 in the center through which nozzle tube 28 of reservoir canister 20 passes.

Coil spring 30 is in communication with the nozzle end of the reservoir canister 20 and front cap 34. Coil spring 30 causes a friction fit of reservoir canister 20, with the base of the concave actuator plate 38. Rear cap 36 also has an aperture 32 which allows communication between plunger 22 and actuator/retainer 38, which are connected by set screw 12. Actuator plate 38 maintains the position of reservoir canister 20 through the opposing pressure of front cap 34 and mounted coil spring 30.

Reservoir canister 20 is seen within housing unit 18 to reciprocate between a first and second position. Reservoir canister 20 may be a straight aerosol container modified to fit inside housing unit 18, and contains a valve 25 (not shown), for releasing the chemical contents. Valve 25 is normally in a position held closed by coil spring 30 which is in communication with the valve end of reservoir canister 20 and front cap 34. This constant communication between the coil spring 30 and front cap 34 prevents the unintentional articulation of the actuator button 40 with actuator ridge 24. Reciprocal movement of actuator base 40 into actuator ridge 24 of front cap 34 causes valve 25 to open, thereby releasing the contents of reservoir canister 20.

In order that reservoir canister 20 reciprocates reliably with respect to nozzle tube 28, housing unit 18 or reservoir canister 20 may be modified to hold reservoir canister 20 stationary within housing unit 18. Such modification may be a friction fit of front cap 34, coil spring 30, reservoir canister 20, actuator plate 38, rear cap 36, and housing unit 18.

Discharge of reservoir canister 20 is effected by depressing actuator button 23. This actuator system is comprised of the two laterally identical buttons 23. Buttons 23 are the ends of plunger shaft 22, which bifurcates into two lateral or forked shafts 222, which terminate in enlarged buttons 23. Enlarged buttons 23*a* of FIG. 2*a* depict an alternate actuator button designed for use on firearms which by virtue of their design do not lend themselves to the originally designed actuator button. More notably, this type of firearm would be a shotgun, rifle, or other large firearm with which the user would not normally use a two-handed grip, but instead would have the nondominant hand on the barrel or stock of the firearm.

Plunger shaft 22 passes through aperture 26 in rear cap 36 and articulates with the round, concave actuator plate 38. In operation, a user's finger depresses button end 23 longitudinally parallel to reservoir canister 20. Plunger shaft 22 is thereby urged forward through aperture 26 of rear cap 36, thus moving actuator/plunger, retainer, plate 38. This movement propels reservoir canister 20 to a forward position until actuator button 40 articulates with actuator ridge 24 and valve 25 opens releasing the fluid within reservoir canister 20, whereby the fluid is discharged through nozzle tube 28.

Because the firearm is pointed in the direction of an assailant, the chemical agent can be effectively discharged by discrete motion of any finger. Moreover, where a tactical situation changes so as to dictate the use of lethal force, the user can immediately do so.

Although FIGS. 1, 2, and 3 relate to and describe a preferred embodiment of the invention that is adaptable and retrofitable to existing weapons, it is also considered that a firearm can be designed and manufactured to incorporate mounting bracket 16 and housing unit 18 as an integral part of the structure of the weapon, thereby eliminating the need for at least flexible mounting arm 15. Indeed, even though there has been described herein above a somewhat detailed description of a preferred embodiment and best mode disclosure of the invention as conceived by the inventor, it will be understood that the invention concept is not by any means limited by specific elements of the invention as delineated above, but will be limited only by the claims appended hereto as interpreted and understood by the above specification.

What is claimed is:

1. A firearm mounted chemical agent dispenser, comprising:

a firearm trigger guard mounting clamp;

a firearm barrel mounting bracket;

a flexible mounting arm coupling said clamp to said bracket and firmly holding said bracket against said firearm barrel;

a canister housing coupled to said mounting bracket;

a canister of compressed chemical agent disposed within said housing, said canister having an actuator button and an exit nozzle in line with said firearm barrel;

a finger actuated plunger proximal to said trigger guard and in communication with said actuator button;

a front cap disposed on said canister housing having an actuator ridge for contact with said actuator button, and an aperture for passage of fluid from said nozzle; and a spring disposed between said actuator ridge and said actuator button.

2. A chemical agent dispenser according to claim 1, wherein said trigger guard mounting clamp consists of a sheet of material wrapped around a trigger guard of said firearm and having front and rear sides conforming to the shape of said trigger guard.

3. A chemical agent dispenser according to claim 2, wherein said trigger guard mounting means is provided with access means to allow one to be able to attach and detach said mounting clamp, and therefor said canister housing, attached thereto, from said trigger guard.

4. A chemical agent dispenser according to claim 1, wherein said barrel mounting bracket consists of a trough shaped slab of metal to be positioned like a saddle on the bottom of the barrel of said firearm.

5. A chemical agent dispenser according to claim 4, wherein said slab of metal is further provided with bracketed and matching extensions of two opposing sides thereof to serve as a pair of slidable mounting rails.

6. A chemical agent dispenser according to claim 1, wherein said flexible mounting arm extends from the rear of said barrel mounting bracket and is curved in such manner to form a close match with and removable containment by said trigger guard mounting clamp.

7. A chemical agent dispenser according to claim 1, wherein said canister housing consists of a cylindrical, hollow chamber with a pair of slidable mounting rails disposed thereon for releasable mounting with said mounting bracket.

8. A chemical agent dispenser according to claim 1, wherein said finger actuated plunger consists of a rod extending into said canister housing on a first end thereof and having a forked termination on the opposing end thereof which extends on either side of the trigger guard of said firearm.

9. A chemical agent dispenser according to claim 8, further having a plate means disposed within said canister housing and attached to said first end of said plunger for acting upon said canister.

10. A chemical agent dispenser according to claim 1, wherein said chemical agent in said canister is any human and animal debilitating and incapacitating fluid that can be compressed in said canister.

11. A chemical agent dispenser according to claim 10, wherein said agent is a liquid.

12. A chemical agent dispenser according to claim 10, wherein said agent is a gas.

13. A chemical agent dispenser according to claim 1, wherein the components thereof are made of hardened metal for reliability and long life.

14. A chemical agent dispenser according to claim 1, wherein the components thereof are made of durable plastic for low costs.

* * * * *